US006414575B1

(12) United States Patent
Swift

(10) Patent No.: US 6,414,575 B1
(45) Date of Patent: Jul. 2, 2002

(54) CIRCUIT BREAKER HAVING AN ENCAPSULATED AUXILIARY COIL ASSEMBLY

(75) Inventor: Thomas R. J. Swift, Monroe, CT (US)

(73) Assignee: Carling Technologies, Inc., Plainville, CT (US)

( * ) Notice: Subject to any disclaimer, the term of this patent is extended or adjusted under 35 U.S.C. 154(b) by 29 days.

(21) Appl. No.: 09/718,075

(22) Filed: Nov. 21, 2000

(51) Int. Cl.[7] ..... H01H 9/00

(52) U.S. Cl. ..... 335/6; 335/21; 335/156; 335/172

(58) Field of Search ..... 335/6–46, 167–176

(56) References Cited

U.S. PATENT DOCUMENTS 4,982,174 A * 1/1991 Fasano ..... 218/149
5,886,605 A * 3/1999 Ulerich et al. ..... 335/167
6,218,921 B1 * 4/2001 Eberts et al. ..... 335/172

* cited by examiner

*Primary Examiner*—Ramon M Barrera
(74) *Attorney, Agent, or Firm*—McCormick, Paulding & Huber LLP

(57) ABSTRACT

A circuit breaker which has an auxiliary coil fitted onto the primary bobbin adjacent the pole piece having a dielectric auxiliary bobbin and a dielectric bobbin housing encapsulating the auxiliary coil and forming an encapsulated auxiliary coil assembly. Both the dielectric auxiliary bobbin and the dielectric bobbin housing are comprised of a polymeric material, preferably a liquid-crystal polymer. Preferably, the liquid-crystal polymer is an aromatic liquid-crystal polyester which is reinforced with about 30% glass and has a nematic liquid-crystal structure. Furthermore, it is preferred for the dielectric strength of the liquid-crystal polymer to be about 32 KV/mm to about 35 KV/mm.

21 Claims, 5 Drawing Sheets

CIRCUIT BREAKER HAVING AN ENCAPSULATED AUXILIARY COIL ASSEMBLY

BACKGROUND OF THE INVENTION

The present invention relates generally to electromagnetic circuit breakers. More particularly, the present invention relates to a circuit breaker having an encapsulated auxiliary electromagnetic coil fitted onto a primary bobbin adjacent a pole piece, and to an insulated bobbin and bobbin housing which encapsulates an auxiliary electromagnetic coil.

Electromagnetic circuit breakers provide a load current/voltage through a primary electromagnetic coil that encompasses a delay tube in which a plunger is adapted to be drawn towards a pole piece at the end of the delay tube by reason of the magnetic flux created in a frame and armature. Once the plunger is drawn to the pole piece because of impermissible conditions, the circuit breaker is tripped causing an open circuit.

Secondary methods of tripping electromagnetic circuit breakers are frequently desirable. A second electromagnetic coil, referred to herein as an auxiliary electromagnetic coil or an auxiliary coil, may be added to the circuitry of the circuit breaker facilitating the tripping of the circuit breaker in response to an over current/voltage condition on the second coil. Typically, the auxiliary coil, and the circuitry connected thereto, must be separated from the primary coil to prevent arcing resulting in a short circuit and premature tripping of the circuit breaker. The UL Laboratories, in UL 489 , specifies a minimum spacing between two conductors within a circuit breaker effectively preventing the utilization of conventional, uninsulated auxiliary and primary coils within the same circuit breaker assembly.

U.S. Pat. No. 4,982,174 ('174), issued to Fasano on Jan. 1, 1991 and assigned to the common assignee, Carlingswitch, Inc., is incorporated herein by reference in its entirety. The patent '174 discloses a molded split case electromagnetic circuit breaker assembly having a second coil, configured as a shunt coil, fitted on a bobbin that is selectively mounted on the bobbin containing the primary electromagnetic coil for the breaker. The circuit breaker housing is adapted to receive either a molded switch subassembly or a terminal strip that is held in place by the primary terminals of the breaker and is adapted to support auxiliary terminals that operate the shunt coil. The magnetic wire of the shunt coil of '174 is exposed to the interior of the circuit breaker housing so that an arc or an induced magnetic field may occur thereby prematurely tripping the circuit breaker.

An auxiliary coil must be magnetically separated from the primary coil to avoid an induced magnetic field in the auxiliary coil. Either an induced magnetic field or a flow of current in the auxiliary coil will result in premature tripping of the circuit breaker.

None of the above inventions and patents, taken either singularly or in combination, is seen to describe the instant invention as claimed.

SUMMARY OF THE INVENTION

The present invention is a circuit breaker having an encapsulated auxiliary electromagnetic coil fitted onto the primary bobbin adjacent the pole piece, and a dielectric auxiliary bobbin and bobbin housing which encapsulate the auxiliary coil. Three circuit breaker configurations utilizing the insulated auxiliary bobbin and bobbin housing are contemplated in the present invention. The dielectric bobbin housing and the auxiliary bobbin are both composed of a dielectric polymeric material, preferably a liquid-crystal polymer, having substantial insulator properties.

The first configuration utilizes an encapsulated auxiliary electromagnetic coil in a split case circuit breaker without a primary coil. The auxiliary coil is connected to the load through either the conventional load terminal or a separate auxiliary load terminal. The first configuration is utilized as a separate relay contact for a stack of circuit breakers. Actuators are connected through the stack so that if one circuit breaker is tripped, all of the circuit breakers in the stack are tripped. Conventionally, the actuator handles are connected to one another by handle ties. This configuration permits the auxiliary electromagnetic coil to serve as a separate unprotected pole of a multi-pole circuit breaker assembly, thereby facilitating remote tripping of the multi-pole circuit breaker assembly.

The second and third configurations utilize an encapsulated auxiliary electromagnetic coil with split case circuit breaker which has a primary electromagnetic coil arrangement. In the second configuration, the auxiliary coil has a separate circuit having an auxiliary load terminal and an auxiliary line terminal thus forming a four terminal relay configuration. In the third embodiment, the auxiliary coil is connected to the circuit on the load side of the primary coil with a line to a separate auxiliary load terminal forming a three terminal shunt configuration.

An object of the present invention is to provide a second coil for tripping a circuit breaker, which will not cause the circuit breaker to trip unnecessarily, meets the current UL standards, and is fitted on top of the primary coil. The liquid-crystal polymer, with which the bobbin housing and auxiliary bobbin are preferably composed, provides enough insulation to permit the primary and auxiliary coils to be placed in close proximity to one another without requiring the wire of the auxiliary coil to be inconveniently thin.

A further object of the present invention is to provide a second trip coil, the auxiliary coil, which can facilitate additional configurations of a circuit breaker. The auxiliary coil assembly of the current invention permits both shunt and relay circuit configurations within the same circuit breaker. Alternatively, the auxiliary coil may be used alone without a primary coil to form a separate relay for a multi-pole circuit breaker assembly.

Another object of the invention is to provide a trip coil which will trip when a small amount of current, or low voltage, is applied to the coil. A sensitive trip coil results, which can be used in a circuit breaker alone or in conjunction with a primary coil, permitting the remote tripping of the circuit breaker.

These and other objects of the present invention will become readily apparent upon further review of the following specification and claims.

BRIEF DESCRIPTION OF THE DRAWINGS

The novel features of the described embodiments are specifically set forth in the appended claims; however, embodiments relating to the structure may best be understood with reference to the following description and accompanying drawings.

Similar reference characters denote corresponding features consistently throughout the attached drawings.

DETAILED DESCRIPTION OF PREFERRED EMBODIMENTS

Figure 5:
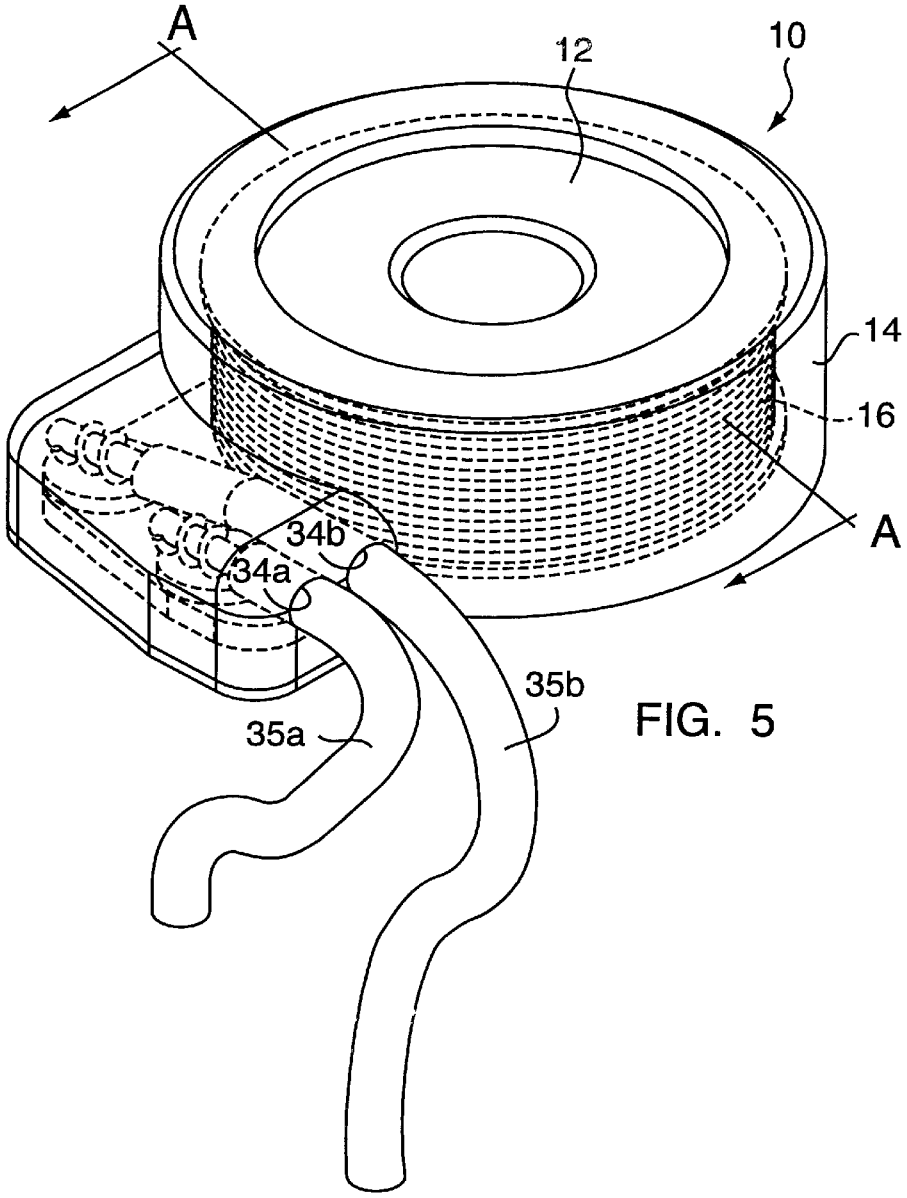
FIG. 5 is a perspective view of an encapsulated auxiliary coil assembly according to the present invention clearly showing the bobbin casing wherein the phantom lines depict the interior of the bobbin casing showing the auxiliary coil, the insulated lead wiring and connection means to attach the insulated lead wiring to the magnetic wiring of the auxiliary coil.
Figure 6:
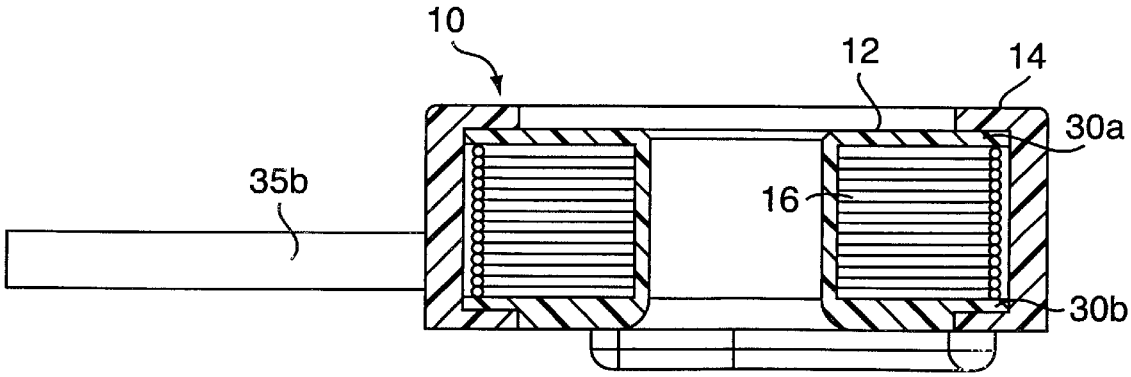
FIG. 6 is a cutaway view of the encapsulated auxiliary coil assembly taken generally on the line A—A of FIG. 5.

A circuit breaker is provided having an auxiliary coil 16 fitted onto the primary bobbin 18 adjacent the pole piece Q having a dielectric auxiliary bobbin 12 and a dielectric bobbin housing 14 encapsulating the auxiliary coil 16 and forming an encapsulated auxiliary coil assembly 10. Four embodiments of circuit breakers that utilize an encapsulated coil assembly 10 for encapsulating an electromagnetic coil are shown in FIGS. 1–4. The components of the encapsulated coil assembly 10, as shown most clearly in FIGS. 5 and 6, are a bobbin 12, a bobbin housing 14, and an electromagnetic coil 16, and lead wires 35*a* and 35*b*. These components are also referred to as an auxiliary bobbin 12, an auxiliary bobbin housing 14 and an auxiliary electromagnetic coil 16 in order to differentiate them from a primary bobbin 18 and a primary electromagnetic coil 20 found in some of the embodiments of the present invention. An electromagnetic coil may also be referred to simply as a coil.

Both the dielectric auxiliary bobbin 12 and the dielectric bobbin housing 14 are composed of a polymeric material, preferably a liquid-crystal polymer. The dielectric liquid-crystal polymer is, most preferably, a glass reinforced aromatic liquid-crystal polyester. Furthermore, it is preferred that the aromatic liquid crystal polyester is reinforced with 25% to 45% glass, preferably 30% to 40% glass, and most preferably 30% glass, and has a nematic liquid-crystal structure. The liquid-crystal polymer, most preferably, has a dielectric strength from about 25 KV/mm to about 45 KV/mm, preferably 32 KV/mm to about 35 KV/mm. Most preferably, the bobbin housing 14 has a dielectric strength of 35 KV/mm and the bobbin has a dielectric strength of 32 KV/mm.

The preferred dielectric liquid-crystal polymer is taken from the group comprising 2-naphthalenecarboxylic acid-6-(acetyloxy)-polymer with 4-(acetyloxy) benzoic acid, and carbomonocyclic carbocyclic polyester, and has about 30% fiber glass reinforcement. These structures have high heat resistance and are highly flame retardant. The preferred polyester liquid-crystal polymers are Vectra® C130 and Vectra® E130i available from Ticona in the United States. These liquid-crystal polymers are fiberglass reinforced (30%) and have dielectric strengths of 35 KV/mm and 32 KV/mm, and arc resistances of 182 seconds and 140 seconds, respectively. Higher dielectric strength and arc resistance is preferred for the auxiliary bobbin housing 14, while the auxiliary bobbin 12 itself may have a lower arc resistance given that the dielectric strength is comparable.

The circuit breaker of the current invention has a housing preferably composed of two molded half sections (herein only the rear section 20 is shown), a frame in the housing, and fixed 22 and movable 24 contacts in the housing. Electromagnetic means, as shown in FIGS. 1–4, is electrically coupled to the fixed 22 and movable 24 contacts. The electromagnetic means includes armature means movably mounted on the frame.

A pole piece Q is supported in fixed relationship to the frame and adapted to be engaged by the armature 26. A plunger tube T which supports the pole piece Q is shown in FIGS. 1–4. A plunger C is movably mounted in the tube T in FIGS. 3 and 4. A primary bobbin 18 surrounds the tube T. The primary bobbin 18 has flanges defining an annular space, as shown in FIGS. 1–4. An auxiliary annular space is defined by the primary bobbin 18 around the pole piece Q. The plunger or delay tube is provided with a pole piece Q at its upper end so that an electromagnetic coil 20 surrounding the tube T is adapted to pull the plunger or core C upwardly against the downward force of a return spring 63 provided between the pole piece Q and a shoulder of the plunger or core C. The delay tube T may be filled with a damping fluid such as oil in order to reduce the speed of movement for the plunger or core C and hence to increase the time required for tripping of the armature 26. The embodiments of the present invention depicted in FIGS. 1 and 2 do not require a plunger or delay tube. The electromagnetic coil 16 pulls the armature 26 directly toward the pole piece Q, as discussed hereinafter, in order to quickly trip the circuit breaker and not delay it.

The auxiliary bobbin 12 of the present invention has flanges 30*a* and 30*b* adjacent its opposite ends, the auxiliary bobbin 12 being selectively received on the primary bobbin 18 to occupy the auxiliary annular space, the auxiliary bobbin 12 having one flange 30*b* located adjacent a flange 32*a* on the primary bobbin 18, and the auxiliary bobbin 12 being comprised of a dielectric polymeric material, preferably a dielectric liquid-crystal polymer.

The auxiliary coil 16 is provided for magnetically moving the armature 26 toward the pole piece Q in response to an over current over voltage condition in the auxiliary coil 16 winding provided on the auxiliary bobbin 12, between the flanges 30*a* and 30*b* thereof, as shown in FIGS. 1–4. An auxiliary bobbin housing 14 is selectively received on the flanges 30*a* and 30*b* of the auxiliary bobbin 12 to enclose the auxiliary coil 16, the auxiliary bobbin housing 14 has openings 34*a* and 34*b* for receiving lead wires 35*a* and 35*b* across the auxiliary coil 16. The openings 34*a* and 34*b* receive the lead wires 35*a* and 35*b* tightly providing both insulation and strain relief. The insulation provided by the openings keeps the lead wires 35*a* and 35*b* separate from one another, the auxiliary coil 16 and from the rest of the circuit breaker. The lead wires 35*a* and 35*b* are completely covered and firmly held into place so that any strain placed on the lead wires 35*a* and 35*b* will not result in their being pulled from the auxiliary bobbin housing 14. The auxiliary bobbin housing 14 is comprised of a dielectric polymeric material, preferably a dielectric liquid-crystal polymer. It is preferred for the auxiliary bobbin housing 14 to be formed over the auxiliary bobbin 12, the auxiliary coil 16, and the lead wires 35*a* and 35*b* so that these parts are fully insulated and firmly held in place.

The circuit breaker may have a primary coil 20 disposed in the annular space which is defined on the primary bobbin 18 for magnetically moving the plunger C toward the pole piece Q in response to an over current over voltage condition in the primary coil 20 winding. If no primary coil 20 is required, then the plunger C may be omitted as the auxiliary coil 16 pulls the armature 26 and the plunger C is not required.

It is preferred that the plunger tube T contains a fluid to dampen movement of the plunger C where a primary coil 20 is utilized due to over voltage, over current conditions in the primary coil windings 20. The pole piece Q has an inner end engageable by the plunger C, when present, and the pole piece Q inner end is located in generally the same place as that defined by the auxiliary bobbin 12 flange adjacent the primary bobbin 18.

There are three preferred terminal configurations contemplated by the current invention. Two relay configurations and a shunt configuration are illustrated in FIGS. 1–4. A relay is an electromagnetic device, for remote or automatic control, which is actuated by variation in conditions of an electric circuit, and operates in turn other devices (as switches) in the same or a different circuit.

Figure 1:
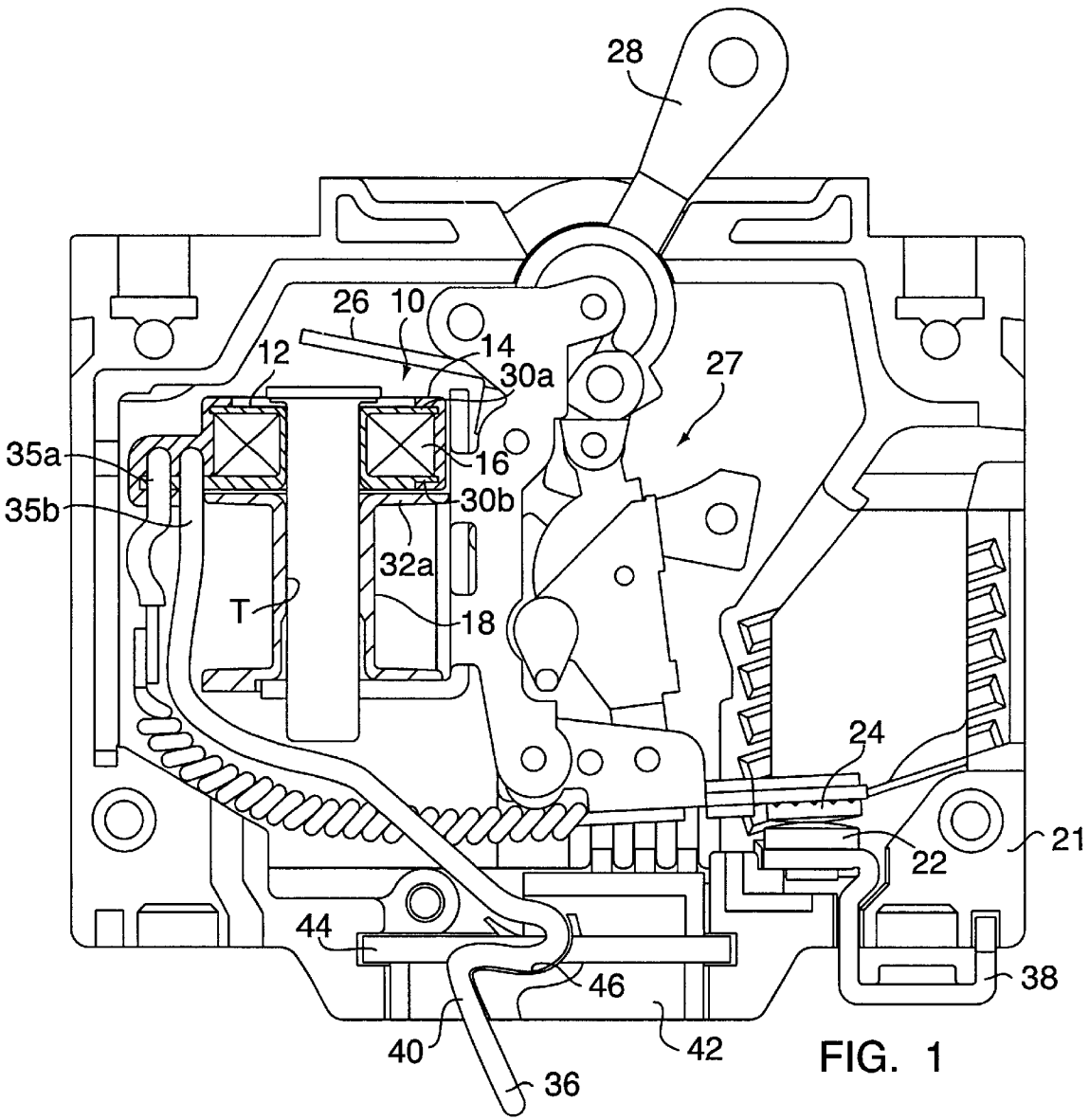
FIG. 1 is a side elevational view of one half section of the circuit breaker housing showing the various components of a typical circuit breaker mechanism and electromagnetic frame assembly provided therein without a primary coil, further illustrating an encapsulated auxiliary coil assembly situated above the primary bobbin, and also illustrating an optional strain relief arrangement to provide an auxiliary load terminal for the auxiliary coil thus depicting the first embodiment of the present invention having two terminals providing a separate relay contact for a stack of circuit breakers.
Figure 2:
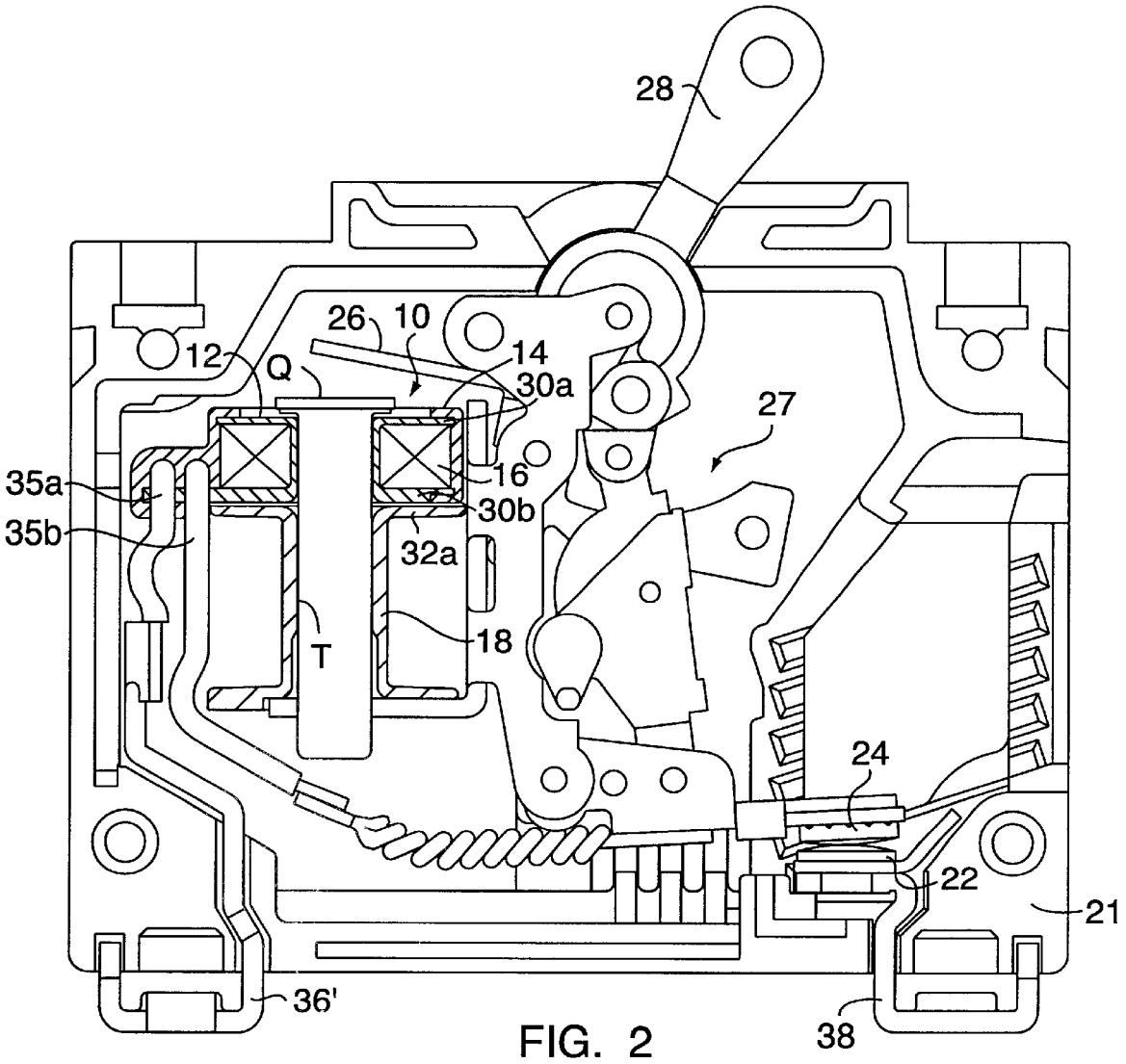
FIG. 2 is a side elevational view of one half section of the circuit breaker housing showing the various components of a typical circuit breaker mechanism and electromagnetic frame assembly provided therein without a primary coil, further illustrating an encapsulated auxiliary coil assembly situated above the primary bobbin, as in FIG. 1, except utilizing the conventional load terminal as an auxiliary load terminal.

The simplest relay configuration includes two terminals 36 (or 36') and 38 only and does not include a primary coil. This type of configuration is illustrated in FIGS. 1 and 2. The circuit breaker shown in FIGS. 1 and 2 has a housing which has front and rear 20 half sections, each section having a top, a bottom, and opposed end walls to define a cavity. Only the rear section 20 of the housing is shown. The half sections have peripheral edge portions mating with one another and each half section has a bottom edge that cooperates to define a generally rectangular well communicating with the cavity. The bottom edges of the peripheral half section edge portions define a groove.

The circuit breaker has an armature 26 with a collapsible toggle mechanism coupled to the armature 26 to move the movable 24 contact in response to an over current over voltage condition in the coil winding through a circuit that includes the fixed 22 and movable 24 contacts. FIGS. 1 and 2 both illustrate a relay terminal configuration which uses only two terminals: a first terminal 38 means electrically connected to the fixed 22 contact and including a portion accessible to one end of the housing, and a second terminal 36 or 36' means electrically connected to the auxiliary electromagnetic coil and including a portion accessible to the opposite end of the housing. The toggle handle 28 may receive a handle tie, not shown, which serves to attach the toggle handles of adjacent circuit breakers such that when one circuit breaker's handle 28 moves, they all move. It is preferred that the second terminal means is an insulated lead wire 40.

Optionally, an auxiliary terminal block 42 may be provided which has laterally opposed flanges 44 received in the grooves in the bottom edge of the peripheral half section edge portions where the block 42 has an S-configured channel 46 for receiving the portion of the insulated lead wire 40 accessible to the opposite end of the housing, as shown in FIG. 1. The S-configured channel 46 is a unique strain relief arrangement that prevents the insulated lead wire 40 from being disengaged from the circuit breaker.

Figure 4:
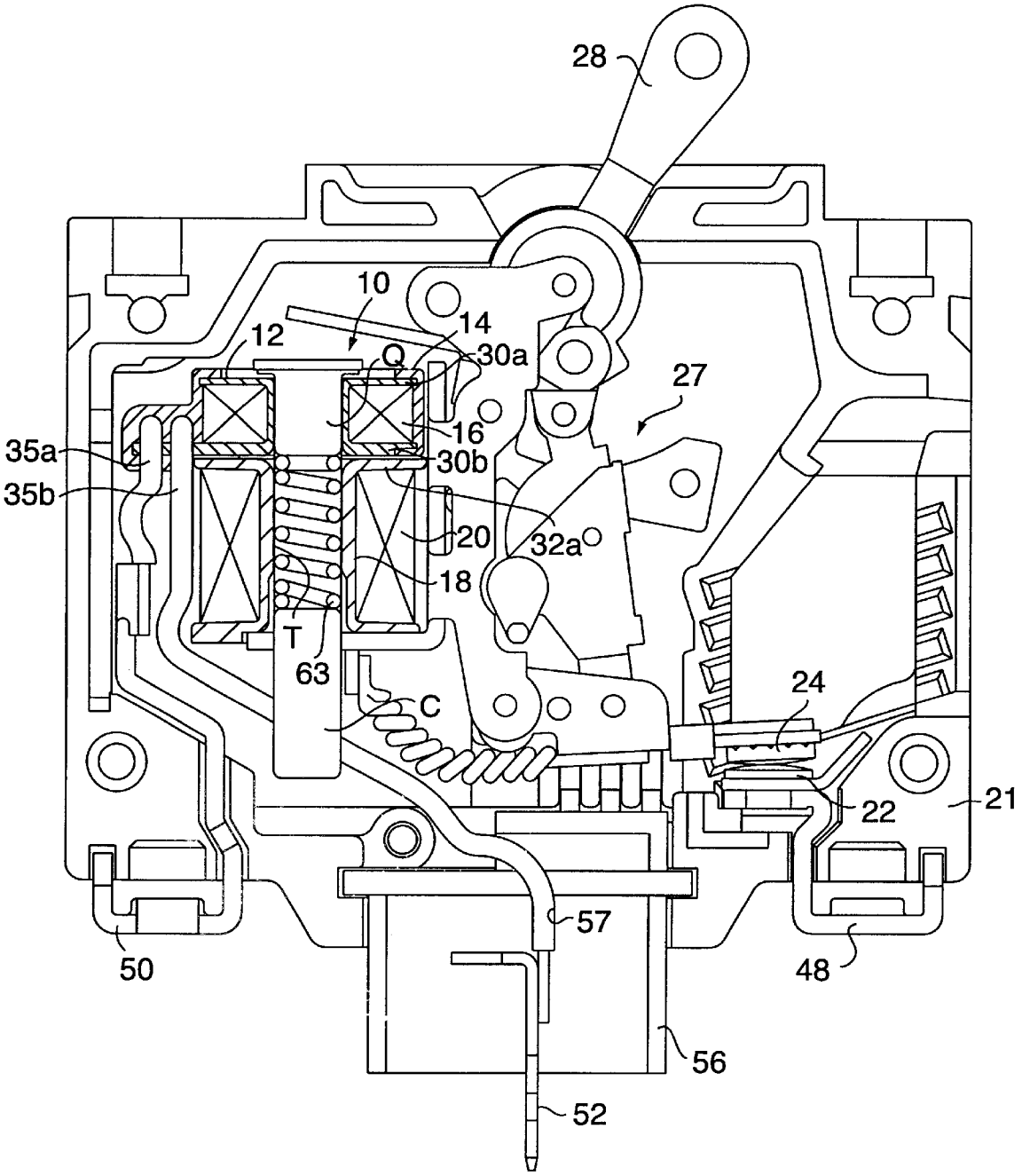
FIG. 4 is a side elevational view of one half section of the circuit breaker housing showing the various components of a typical circuit breaker mechanism and electromagnetic frame assembly provided therein, further illustrating an encapsulated auxiliary coil assembly situated above the primary bobbin, and also illustrating an alternative terminal defining means to include an auxiliary load terminal for the auxiliary coil thus depicting a third embodiment of the present invention having a three terminal shunt configuration.

The second embodiment of the terminal configuration utilizes three terminals 48, 50, and 52 creating a shunt configuration, and is more clearly shown in FIG. 4. As with the two terminal embodiments, the housing has a front half section (not shown) and a rear half section 20, each section having a top, a bottom, and opposed end walls to define a cavity. The half sections have peripheral edge portions which mate with one another, and each half section has a bottom edge which cooperates to define a generally rectangular well communicating with the cavity. The bottom edges of the peripheral half section edge portions define a groove. An armature 26 is provided which has a collapsible toggle mechanism 27 coupled to the armature 26 to move the movable contact 24 in response to an over current over voltage condition in the coil winding through a circuit that includes the fixed 22 and movable 24 contacts.

The terminal configuration of the second embodiment are a first terminal 48 means electrically connected to the fixed contact 22 and including a portion accessible to one end of the housing, a second terminal 50 means electrically connected to the primary electromagnetic coil and to the auxiliary electromagnetic coil and including a portion accessible to the opposite end of the housing, and a third terminal 52 means electrically connected to the auxiliary electromagnetic coil and including a portion accessible to the opposite end of the housing completing an auxiliary circuit through the auxiliary coil 16 serving to move the movable 24 contact in response to an over current over voltage condition in the auxiliary coil 16 winding. Preferably, the third terminal means of the second embodiment is via an insulated lead wire similar to the second terminal means of the first embodiment as shown in FIG. 1.

Additionally, an auxiliary terminal block, as in FIG. 1, may be provided which has laterally opposed flanges received in the grooves in the bottom edge of the peripheral half section edge portions, and an S-configured channel for receiving the portion of the insulated lead wire accessible to the opposite end of the housing. Alternatively, a terminal block 56 may be provided with a straight channel 57 as shown in FIG. 4.

Figure 3:
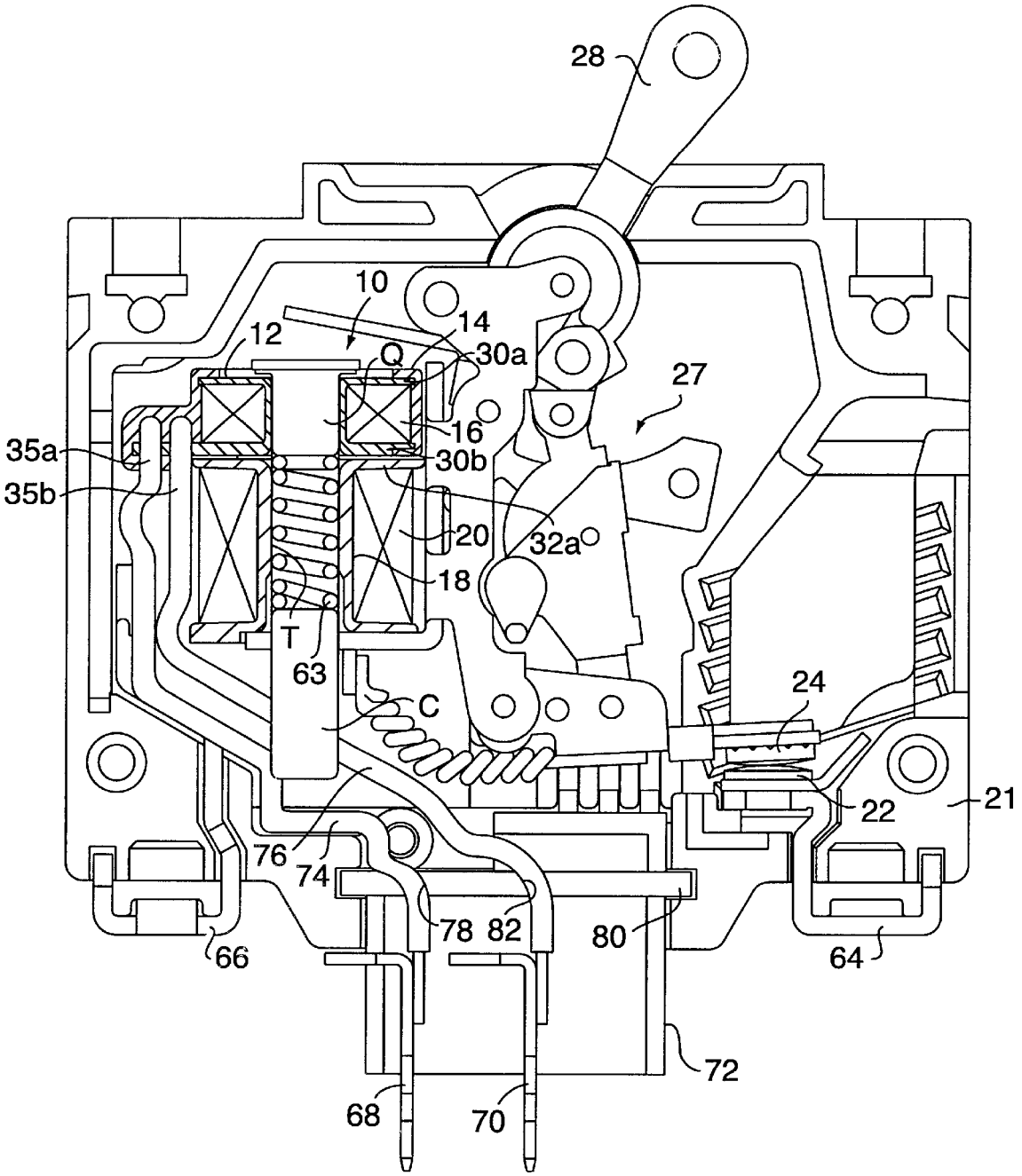
FIG. 3 is a side elevational view of one half section of the circuit breaker housing showing the various components of a typical circuit breaker mechanism and electromagnetic frame assembly provided therein, further illustrating an encapsulated auxiliary coil assembly situated above the primary bobbin, and also illustrating an alternative terminal defining means to include two auxiliary terminals for the auxiliary coil thus depicting a second embodiment of the present invention having a four terminal relay configuration.

The third embodiment of the terminal configuration utilizes four terminals 64, 66, 68 and 70 creating a relay configuration, and is more clearly shown in FIG. 3. As with the first two embodiments of the present invention, the housing has a front half section (not shown) and a rear half section 20, each section having a top, a bottom, and opposed end walls to define a cavity. The half sections have peripheral edge portions which mate with one another, and each half section has a bottom edge which cooperates to define a generally rectangular well communicating with the cavity. The bottom edges of the peripheral half section edge portions define a groove. An armature 26 is provided which has a collapsible toggle mechanism 27 coupled to the armature 26 to move the movable 24 contact in response to an over current over voltage condition in the primary coil winding through a circuit that includes the fixed 22 and movable 24 contacts.

The terminal configuration of the third embodiment has four terminal means corresponding to the four terminals. The first terminal 64 means is electrically connected to the fixed 22 contact, and includes a portion accessible to one end of the housing. The second terminal 66 means is electrically connected to the primary electromagnetic coil, and includes a portion accessible to the opposite end of the housing. The third terminal 68 means is electrically connected to the auxiliary electromagnetic coil, and includes a portion accessible to the opposite end of the housing. The fourth terminal 70 means is electrically connected to the auxiliary electromagnetic coil 16, and includes a portion accessible to the opposite end of the housing completing an auxiliary circuit through the auxiliary coil 16 serving to move the movable contact 24 in response to an over current over voltage condition in the auxiliary coil 16 winding. Preferably, the third 68 and fourth terminal 70 means are insulated lead wires 74 and 76.

Optionally, an auxiliary terminal block 72 may be provided which has laterally opposed flanges 80 received in the grooves in the bottom edge of the peripheral half section edge portions and two parallel channels 78 and 82 for receiving the portions of the insulated lead wires 74 and 76 accessible to the opposite end of the housing.

It is to be understood that the present invention is not limited to the embodiments described above, but contemplates any encapsulated bobbin utilized in a circuit breaker. The present invention further encompasses any and all embodiments within the scope of the following claims.

What is claimed is:

1. A circuit breaker comprising:

a housing, a frame in the housing, fixed and movable contacts in the housing;

electromagnetic means electrically coupled to said fixed and movable contacts, said electromagnetic means including armature means movably mounted on said frame;

a pole piece supported in fixed relationship to said frame and adapted to be engaged by said armature;

a plunger tube for supporting said pole piece;

a primary bobbin surrounding said tube, said primary bobbin having flanges defining an annular space;

an auxiliary annular space defined by said primary bobbin around said pole piece;

an auxiliary bobbin having flanges adjacent its opposite ends, said auxiliary bobbin being selectively received on said primary bobbin to occupy said auxiliary annular space, said auxiliary bobbin having one flange located adjacent a flange on said primary bobbin, and said auxiliary bobbin being comprised of a dielectric liquid-crystal polymer;

an auxiliary coil for magnetically moving said armature means toward said pole piece in response to an over current over voltage condition in the auxiliary coil winding provided on said auxiliary bobbin, between said flanges thereof; and an auxiliary bobbin housing being selectively received on said flanges of said auxiliary bobbin to enclose said auxiliary coil, said auxiliary bobbin housing having channels for receiving wiring across said auxiliary coil, said auxiliary bobbin housing being comprised of a dielectric liquid-crystal polymer.

2. The circuit breaker of claim 1 wherein the dielectric liquid-crystal polymer is a glass reinforced aromatic liquid-crystal polyester.

3. The circuit breaker of claim 2 wherein the aromatic liquid crystal polyester is reinforced with 30% glass and has a nematic liquid-crystal structure.

4. The circuit breaker of claim 1 wherein the liquid-crystal polymer has a dielectric strength from about 32 KV/mm to about 35 KV/mm.

5. The circuit breaker of claim 1, wherein:

said housing has front and rear half sections, each section having a top, a bottom, and opposed end walls to define a cavity;

said half sections having peripheral edge portions mating with one another and each half section having a bottom edge which cooperates to define a generally rectangular well communicating with said cavity;

said bottom edges of said peripheral half section edge portions defining a groove; and further comprising an armature having a collapsible toggle mechanism coupled to said armature to move said movable contact in response to an over current over voltage condition in said coil winding through a circuit that includes said fixed and movable contacts;

a first terminal means electrically connected to said fixed contact and including a portion accessible to one end of said housing; and a second terminal means electrically connected to said auxiliary electromagnetic coil and including a portion accessible to the opposite end of said housing.

6. The circuit breaker of claim 5, wherein:

said second terminal means is an insulated lead wire; and further comprising an auxiliary terminal block having laterally opposed flanges received in said grooves in the bottom edge of said peripheral half section edge portions and an S-configured channel for receiving the portion of said insulated lead wire accessible to the opposite end of said housing.

7. The circuit breaker of claim 1, further comprising:

a plunger movably mounted in said tube; and a primary coil disposed in the annular space defined on said primary bobbin for magnetically moving said plunger toward said pole piece in response to an over current over voltage condition in the primary coil winding.

8. The circuit breaker of claim 7 wherein the dielectric liquid-crystal polymer is a glass reinforced aromatic liquid-crystal polyester.

9. The circuit breaker of claim 8 wherein the aromatic liquid crystal polyester is reinforced with 30% glass and has a nematic liquid-crystal structure.

10. The circuit breaker of claim 7 wherein the liquid-crystal polymer has a dielectric strength from about 32 KV/mm to about 35 KV/mm.

11. The circuit breaker of claim 7 wherein:

said plunger tube contains a fluid to dampen movement of said plunger due to over voltage, over current conditions in said coil windings, said pole piece having an inner end engageable by said plunger, and said pole piece inner end being located in generally the same place as that defined by said auxiliary bobbin flange adjacent said primary bobbin.

12. The circuit breaker of claim 7, wherein:

said housing has front and rear half sections, each section having a top, a bottom, and opposed end walls to define a cavity;

said half sections having peripheral edge portions mating with one another and each half section having a bottom edge which cooperates to define a generally rectangular well communicating with said cavity;

said bottom edges of said peripheral half section edge portions defining a groove; and further comprising an armature having a collapsible toggle mechanism coupled to said armature to move said movable contact in response to an over current over voltage condition in said coil winding through a circuit that includes said fixed and movable contacts;

a first terminal means electrically connected to said fixed contact and including a portion accessible to one end of said housing; and a second terminal means electrically connected to said primary electromagnetic coil and to said auxiliary electromagnetic coil and including a portion accessible to the opposite end of said housing; and a third terminal means electrically connected to said auxiliary electromagnetic coil and including a portion accessible to the opposite end of said housing completing an auxiliary circuit through said auxiliary coil serving to move said movable contact in response to an over current over voltage condition in said auxiliary coil winding.

13. The circuit breaker of claim 12, wherein:

said third terminal means is an insulated lead wire; and further comprising an auxiliary terminal block having laterally opposed flanges received in said grooves in the bottom edge of said peripheral half section edge portions and a channel for receiving the portion of said insulated lead wire accessible to the opposite end of said housing.

14. The circuit breaker of claim 7, wherein:

said housing has front and rear half sections, each section having a top, a bottom, and opposed end walls to define a cavity;

said half sections having peripheral edge portions mating with one another and each half section having a bottom edge which cooperates to define a generally rectangular well communicating with said cavity;

said bottom edges of said peripheral half section edge portions defining a groove; and further comprising an armature having a collapsible toggle mechanism coupled to said armature to move said movable contact in response to an over current over voltage condition in said coil winding through a circuit that includes said fixed and movable contacts;

a first terminal means electrically connected to said fixed contact and including a portion accessible to one end of said housing; and a second terminal means electrically connected to said primary electromagnetic coil and including a portion accessible to the opposite end of said housing;

a third terminal means electrically connected to said auxiliary electromagnetic coil and including a portion accessible to the opposite end of said housing; and a fourth terminal means electrically connected to said auxiliary electromagnetic coil and including a portion accessible to the opposite end of said housing completing an auxiliary circuit through said auxiliary coil serving to move said movable contact in response to an over current over voltage condition in said auxiliary coil winding.

15. The circuit breaker of claim 14, wherein:

third and fourth terminal means are insulated lead wires; and further comprising an auxiliary terminal block having laterally opposed flanges received in said grooves in the bottom edge of said peripheral half section edge portions and two parallel channels for receiving the portions of said insulated lead wires accessible to the opposite end of said housing.

16. A circuit breaker comprising:

a housing, a frame in the housing, fixed and movable contacts in the housing;

electromagnetic means electrically coupled to said fixed and movable contacts, said electromagnetic means including armature means movably mounted on said frame;

an encapsulated coil assembly for encapsulating an electromagnetic coil, said assembly comprising;

a bobbin having flanges adjacent its opposite ends wherein said bobbin is comprised of a dielectric polymeric material;

an electromagnetic coil provided on said bobbin, between said flanges thereof;

a bobbin housing being selectively received on said flanges of said bobbin to enclose said coil, said bobbin housing having channels for receiving wiring across said coil, wherein said bobbin housing is comprised of a dielectric polymeric material; and wherein said electromagnetic coil is electrically connected to said electromagnetic means such that an over current over voltage condition in said coil winding serves to move said movable contact.

17. The circuit breaker of claim 16 wherein the dielectric polymeric material is a dielectric liquid-crystal polymer.

18. The circuit breaker of claim 17 wherein the dielectric liquid-crystal polymer is a glass reinforced aromatic liquid-crystal polyester.

19. The circuit breaker of claim 18 wherein the aromatic liquid crystal polyester is reinforced with about 30% glass and has a nematic liquid-crystal structure.

20. The circuit breaker of claim 17 wherein the liquid-crystal polymer has a dielectric strength from about 32 KV/mm to about 35 KV/mm.

21. The circuit breaker of claim 17 wherein said electromagnetic coil is electrically connected to said electromagnetic means via lead wires.

* * * * *

UNITED STATES PATENT AND TRADEMARK OFFICE

CERTIFICATE OF CORRECTION

PATENT NO. : 6,414,575 B1
DATED : July 2, 2002
INVENTOR(S) : Swift

It is certified that error appears in the above-identified patent and that said Letters Patent is hereby corrected as shown below:

Title page,
Item [*] Notice, delete the phrase “by 29 days” and insert -- by 0 days --

Signed and Sealed this

Eighteenth Day of May, 2004

JON W. DUDAS
*Acting Director of the United States Patent and Trademark Office*